US005328286A

United States Patent [19]

Lee

[11] Patent Number: 5,328,286

[45] Date of Patent: Jul. 12, 1994

[54] TENT FRAME BINDING DEVICE

[75] Inventor: Yong K. Lee, Kyoungki-do, Rep. of Korea

[73] Assignee: Bae Jin Corporation, Seoul, Rep. of Korea

[21] Appl. No.: 988,207

[22] Filed: Dec. 9, 1992

[30] Foreign Application Priority Data

Apr. 2, 1992 [KR] Rep. of Korea ..... 5399/1992
Jul. 3, 1992 [KR] Rep. of Korea ..... 12204/1992

[51] Int. Cl.[5] ..... E04H 15/36

[52] U.S. Cl. ..... 403/218; 403/102; 403/170; 403/353; 135/102

[58] Field of Search ..... 403/218, 217, 169-176, 403/178, 102, 354, 353; 135/102, 103, 106, 107, 109; 52/6

[56] References Cited

U.S. PATENT DOCUMENTS

| | | | |
|---|---|---|---|
| 721,427 | 2/1903 | Cope | 403/353 |
| 1,807,782 | 6/1931 | Fuchs | 403/353 |
| 4,202,363 | 5/1980 | Watts et al. | 135/105 X |
| 4,750,509 | 6/1988 | Kim | 135/102 |
| 4,941,499 | 7/1990 | Pelsue et al. | 135/106 X |
| 4,966,178 | 10/1990 | Eichhorn | 135/106 X |
| 5,195,551 | 3/1993 | Ju | 135/102 |

*Primary Examiner*—Randolph A. Reese
*Assistant Examiner*—Harry C. Kim
*Attorney, Agent, or Firm*—James D. Hall

[57] ABSTRACT

A tent frame binding device permitting speedy assembling and disassembling is disclosed. A binding body is provided with a plurality of slots angularly separated around it, and a pair of fastening recesses are formed at the side walls of each of the slots, the recesses being open upwardly. At the rear portion of each of the slots, there is formed an engaging step, and a frame member fastening part which is coupled with each of the slots is provided with a supporting shaft, the supporting shaft being coupled with the recesses of the slot. At the rear of the supporting shaft, there is formed an inclined portion which is to be coupled with the inclined engaging step of the slot. Tent frame members are inserted respectively into the holes of the frame member fastening parts, and the frame member fastening parts are assembled into the slots of the binding body. After assembling the frame member fastening parts into the slots of the binding body, a securing plate is fastened to the top of the binding body by driving a bolt through the securing plate into the binding body, thereby preventing the departure of the frame member fastening parts from the slots.

3 Claims, 3 Drawing Sheets (PRIOR ART)

TENT FRAME BINDING DEVICE

FIELD OF THE INVENTION

The present invention relates to a tent frame binding device in which the frame members of a tent can be assembled and disassembled in a speedy manner.

BACKGROUND OF THE INVENTION

A prior art of the tent frame binding device is disclosed in Korean Utility Model Publication No. 90-2935 and U.S. Pat. No. 4,750,509, both of which were granted to the present applicant, and the structure of which is illustrated in FIGS. 5 and 6. As shown in these drawings, a plurality of slots 70 are formed angularly separated on a securing disc 100, and a pair of fastening recesses 90 having a engaging step 80 therein are formed in each of the slots 70. The end portion of each of frame members 30 is T-shaped, because it has a pair of fastening pins 40. First, each of the frame members 30 is inserted into each of the slots 70 of the securing disc 100, and then, the frame member 30 is pivoted one half rounds so that the fastening pins 40 of the frame member 30 should be disposed within the two fastening recesses 90. Then the frame member 30 is pulled up, so that the fastening pins 40 should be engaged with the engaging step 80. Then if the frame members 30 are laid horizontally and are pushed down, the frame members 30 are lifted up, with each of the end portions of the frame members 30 being settled on a settling bottom 60, resulting in that the fastening pins 40 are assembled into the fastening recess 90. On the other hand, if the frame members 30 are to be disengaged from the securing disc 100, the frame members 30 are made to stand upright, and a slight force is applied, so that the fastening pins 40 which have been supported on the engaging step 80 of the fastening recess 90 should depart therefrom.

In the tent frame binding device of the prior art which is constituted as described above, the process of forming the fastening recess and the engaging steps within the securing disc is very difficult and complicated. Therefore, many steps of manufacturing process is required, and much time is consumed, with the result that the manufacturing cost is increased. Further, when assembling the tent frames, each of the frame members has to be sufficiently inserted into each of the slots, the frame members have to be pulled up, and have to be turned by 180° so as for the fastening pins to be aligned with the fastening recess. Then the frame members have to be laid down, and have to be pushed down, thereby making the fastening pins engaged with the engaging step. Thus the frame members cannot be bound by a single manipulation, and much inconvenience is accompanied. Particularly, when assembling the frame members, each of the frame members has to be made to stand upright, and therefore, the space of the assembling place has to be large, and non-skilled persons are forced to experience much difficulty in performing the assembling work, thereby aggravating the productivity.

Another problem is seen in the fastening portions of the frame members.

That is, when the tent is unfolded into a dome shaped tent, with the frame members being deflected, the supporting force is focused on the fastening pins. Consequently, much stress is accumulated on the fastening pins, and therefore, the frame members become weak after some use, with the possible result that the fastening pins may be broken or damaged.

SUMMARY OF THE INVENTION

The present invention is intended to overcome the above described disadvantages of the conventional techniques.

Therefore it is the object of the present invention to provide a tent frame binding device in which the structure of the fastening portion of the frame members is simple, the fastening portions of the frame members cannot easily depart, and the assembling work can be speedily carried out by fitting only the tips of the frame members.

In achieving the above object, a binding body is provided with a plurality of slots angularly separated for fitting frame members, a pair of U shaped fastening recesses are formed on the side walls of the slots, supporting shafts formed on the both sides of the fastening portion of the frame member are fitted into the fastening recesses, and the top of the binding body is covered with a securing plate.

It is another object of the present invention to provide a tent frame binding device in which the rear portions of the supporting shafts have a strong strength, so that, when the tent is unfolded, the distress of the supporting shafts should be greatly alleviated.

In achieving the above object, the slots of the binding body are formed deep, inclined engaging steps are formed only on the rear portion of the slots, and an inclined portion is formed on the rear portions of the supporting shafts of the frame members, so that, when the frame members are inserted into the slots, the inclined portions should be supported by the engaging steps of the rear portions of the slots.

BRIEF DESCRIPTION OF THE DRAWINGS

The above objects and other advantages of the present invention will become more apparent by describing in detail the preferred embodiment of the present invention with reference to the attached drawings in which.

DESCRIPTION OF THE PREFERRED EMBODIMENT

Figure 1:
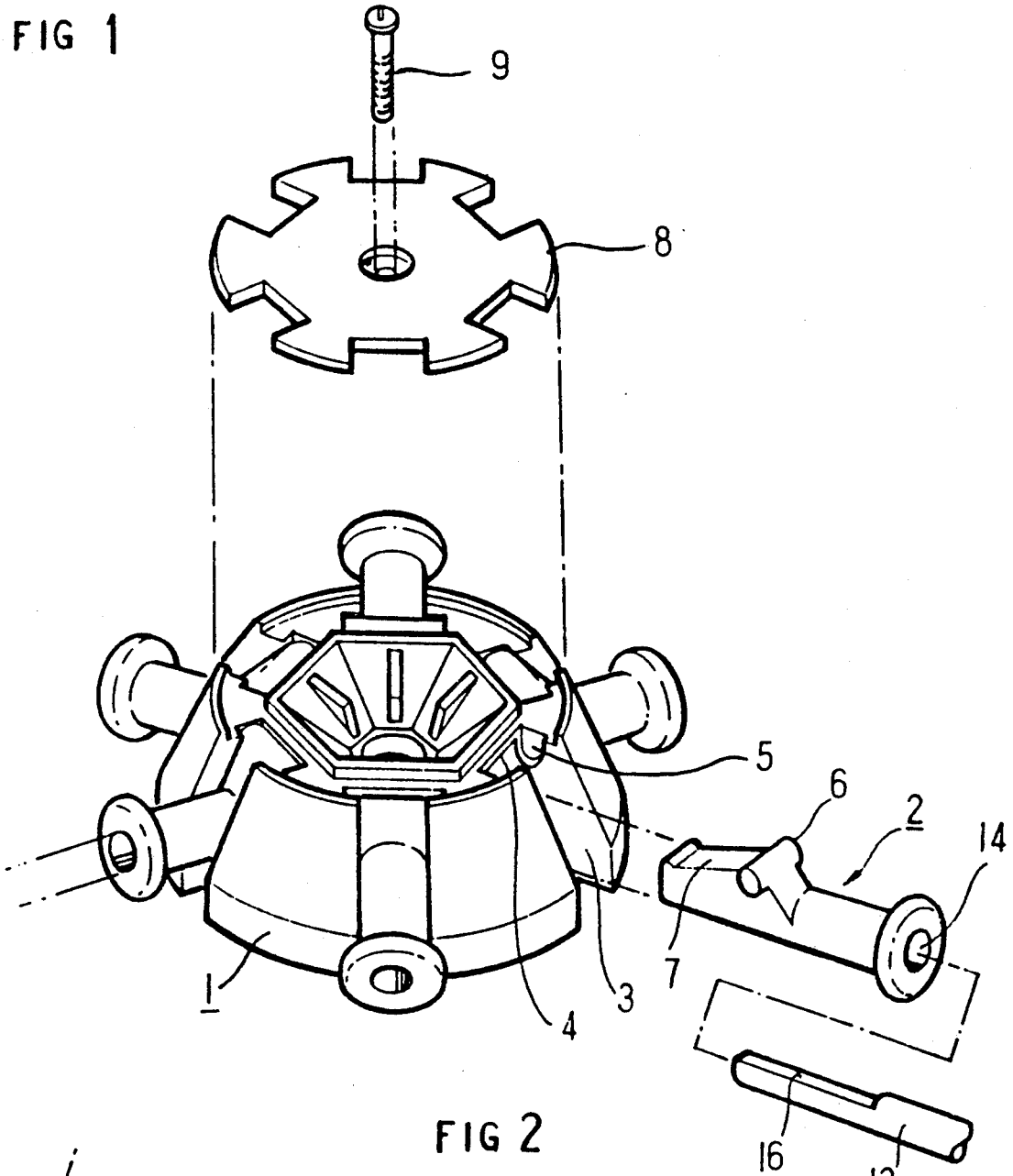
FIG. 1 is an exploded perspective view of the tent frame binding device according to the present invention.
Figure 2:
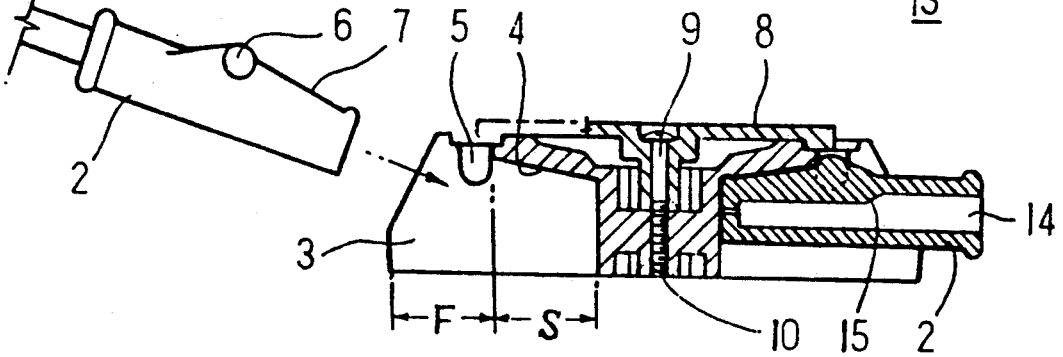
FIG. 2 is a sectional view of the device of FIG. 1.

A binding body 1 of the present invention has a contour of narrow top and wide bottom, and a plurality of slots 3 are formed around the binding body 1 angularly separated. Each of frame member fastening parts 2 is pivotally inserted into each of the slots 3. The slots 3 extend deep into the center of the binding body 1, and a front portion F of the slot 3 is open upwardly and downwardly, while only an engaging step 4 of a rear portion S of the slot 3 closes the top of the slot to support the frame member fastening part 2. Meanwhile, a pair of U shaped fastening recesses 5 are formed on a front portion F of the side walls of the slot 3, the recesses 5 being open upwardly.

The frame member fastening part 2 which is coupled with the slot 3 is provided with a supporting shaft 6 and an inclined portion 7. The supporting shaft 6 projects to left and right from the body of the fastening part 2, and has the shape of a circular rod, so that it can be settled into the fastening recesses 5 of the slot 3. The inclined portion 7 formed at the rear of the supporting shaft 6 is inserted deep into the rear portion S of the slot 3 to be supported by the engaging step 4. The inner surface of the engaging step 4 is inclined correspondingly with the inclined portion 7.

The top of the binding body 1 is covered with a securing plate 8, which is fastened to the binding body 1 by driving a bolt 9 through a hole of the securing plate 8 into a thread hole 10 of the binding body 1. The securing plate 8 is intended to prevent the departure of the frame member fastening part 2 from the slot 2.

Further, the frame member fastening part 2 which has the shape of a socket has an insertion hole 14 for fitting a frame member 13, with a key 15 being projected within the hole 14. The frame member 13 is provided with a flat face 16, so that the frame member 13 cannot be turned, with the flat face 16 and the key 15 being coupled together.

In the tent frame binding device of the present invention constituted as described above, if a frame member 13 is to be fitted into the frame member fastening part 2, the frame member 13 is inserted into the insertion hole 14 of the part 2, with the key 15 and the flat portion 16 being aligned together. If the frame member fastening part 2 is to be joined to the binding body 1, the frame member fastening part 2 is inserted into the slot 3 in a slightly inclined manner, and then, the supporting shaft 6 is made to be settled into the fastening recesses 5, with the inclined portion 7 being disposed on the rear portion S of the slot 3.

After the insertion of the frame member fastening parts 2 into the binding body 1, the frame members 13 are laid down horizontally, and the securing plate 8 is put on the top of the binding body 1 to fasten the securing plate 8 to the binding body 1 by driving the bolt 9 through the plate 8 into the body 1, thereby completing the assembling of the tent frame. If the frame is to be disassembled for a repair or the like, the bolt 9 is unfastened, and the plate 8 is removed. Then the relevant frame member fastening part 2 is lifted up, and pulled out in an easy manner.

In other words, the binding body 1 is provided with a plurality of slots 3 angularly separated, and a pair of fastening recesses 5 are formed in each of the slots 3, so that the frame member fastening parts 2 can be easily assembled into the slots 3. Further, an engaging step 4 is formed on the rear portion S of the slot 3, so that the inclined portion 7 can be supported on it. Therefore, when the tent is unfolded, the supporting force is spread to the inclined portions 7, so that the supporting shafts 6 should not be over-burdened. Consequently, the accumulation of stress on the supporting shafts 6 can be avoided. Further, no special skill is required in assembling and disassembling the frame members, so that the user should be able to easily repair the tent.

Now the second embodiment of the present invention will be described.

Figure 3:
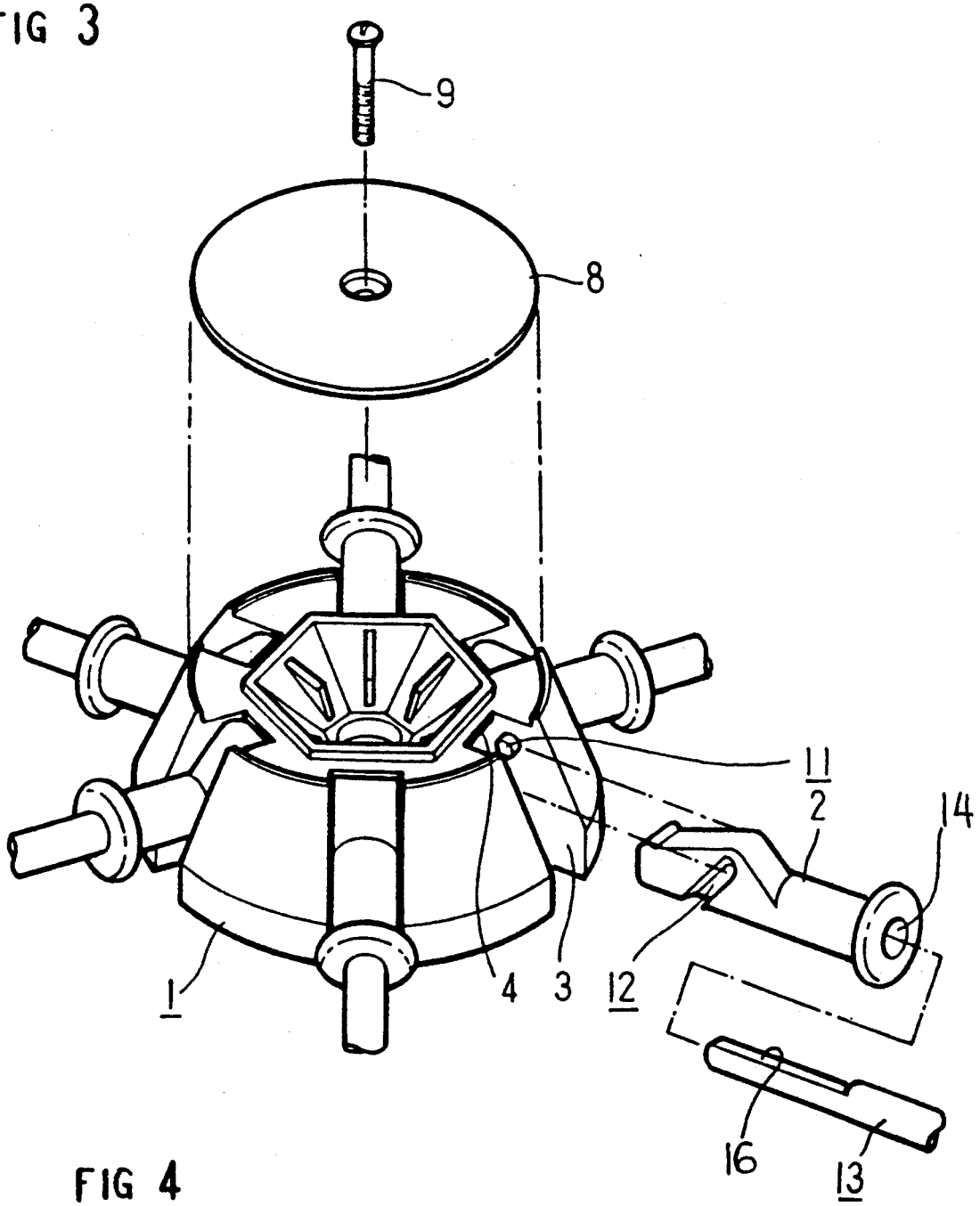
FIG. 3 illustrates another embodiment of the tent frame binding device according to the present invention.
Figure 4:
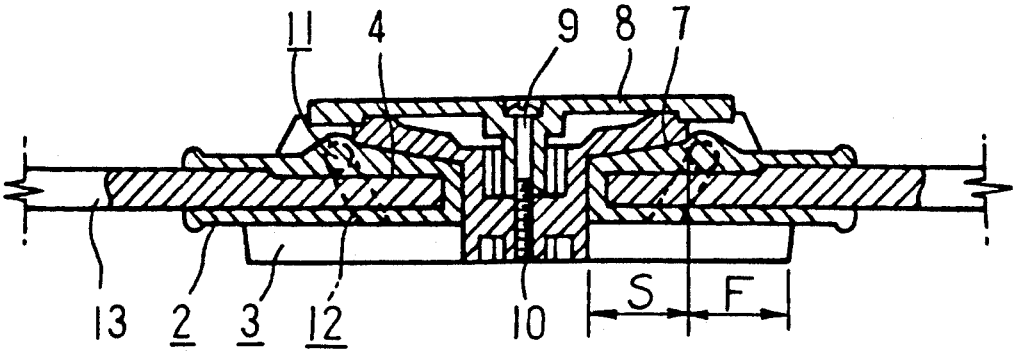
FIG. 4 is a sectional view of the device of FIG. 3.
Figure 5:
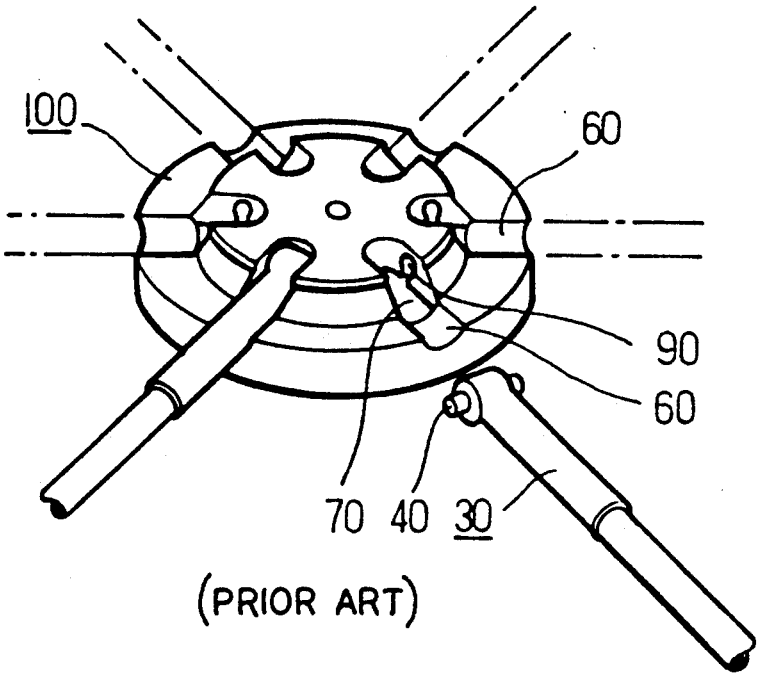
FIG. 5 is a perspective view showing the structure of the conventional tent frame binding device.
Figure 6:
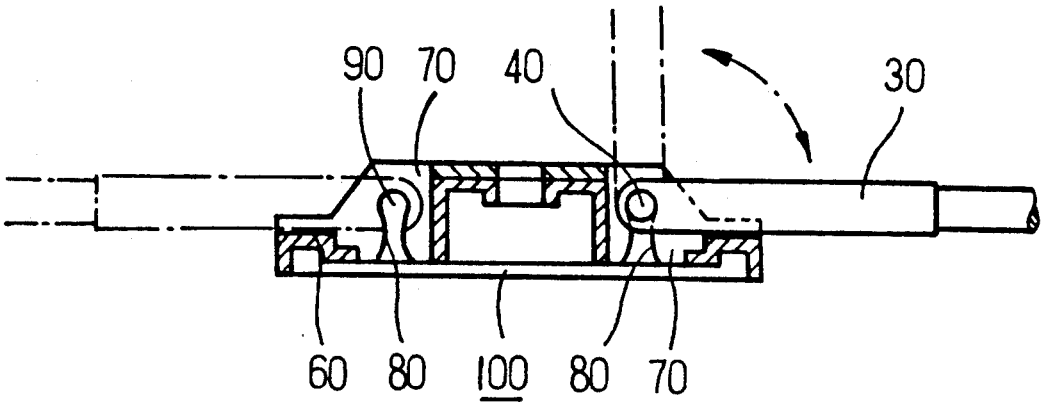
(PRIOR ART) FIG 6
FIG. 6 is a sectional view of the device of FIG. 5.

As shown in FIGS. 3 and 4, the tent frame binding device includes a binding body 1 and a plurality of frame member fastening parts 2 as in the case of the first embodiment described above. A plurality of slots 3 are formed around the binding body 1 for inserting a frame member fastening part 2 into each of the slots 3. A pair of supporting shafts 11 are formed on the side walls of each of the slots 3, and an inclined engaging step 4 is formed on the rear portion S of the slots 3. A pair of recesses 12 are formed on the left and right sides of the frame member fastening part 2, with the recesses 12 being opened downwardly, so that the recesses 12 can be coupled with the supporting shafts 11 of the slot 3. At the rear of the recesses 12 of the frame member fastening part 2, there is formed an inclined portion 7 so as for it to be coupled with the rear portion S of the slot 3 of the binding body 1. Thus the recesses 12 of the frame member fastening part 2 are coupled with the supporting shafts 11 of the slots 3, and then, a securing plate 8 is fastened to the top of the binding body 1 by driving a bolt 9 through the securing plate 8 into the top of the binding body 1.

The tent frame binding device of the present invention makes it possible to assemble and disassemble the frame members to and from the binding body in a speedy manner.

What is claimed is:

1. A tent frame binding device including a binding body (1), a plurality of slots (3) formed around said binding body (1), and a plurality of frame member fastening parts (2) for being joined into said slots (3), the device further comprising:

a pair of fastening recesses (5) formed on side walls of each of said slots (3), said recesses (5) being open upwardly;

an inclined engaging step (4) formed on an upper portion of a rear portion (S) of said slot (3);

a supporting shaft (6) formed on a top of said frame member fastening part (2), said supporting shaft (6) projecting to left and right of said frame member fastening part (2);

an inclined portion (7) formed on said frame member fastening part (2) at a rear of said supporting shaft (6) so as for said inclined portion (7) to be coupled with said inclined engaging step (4); and a securing plate (8) for fastening to a top of said binding body (1), whereby inserting said frame member fastening part (2) into said slots (3), and fastening said securing plate (8) to the top of said binding body (1) by driving a bolt (9) through said securing plate (8) into said binding body (1).

2. The tent frame binding device as claimed in claim 1, wherein a key (15) is provided in an insertion hole (14) of said frame member fastening part (2), and a flat face (16) is formed on a frame member (13), so as for said key (15) and said flat face (16) to be aligned, when inserting said frame member (13) into the hole (14) of said frame member fastening part (2).

3. A tent frame binding device including a binding body, a plurality of slots formed around said binding body, and a plurality of frame member fastening parts for being joined into said slots, the device further comprising supporting shafts formed on side walls of said slot of said binding body, said frame member fastening part provided with a pair of recesses on opposite sides thereof wherein said recesses are coupled with said supporting shafts of said slot, an inclined engaging step formed on an upper portion of a rear portion of said slot, an inclined portion formed on said frame member fastening part at a rear of said recesses so as for said inclined portion to be coupled with said inclined engaging step, and a securing plate for fastening to a top of said binding body whereby inserting said frame member fastening part into said slots and fastening said securing plate to the top of said binding body by driving a bolt through said securing plate into said binding body.

* * * * *